United States Patent [19]

Vataru

[11] Patent Number: 4,797,134

[45] **Date of Patent: * Jan. 10, 1989**

[54] ADDITIVE COMPOSITION, FOR GASOLINE

[75] Inventor: Marcel Vataru, Los Angeles, Calif.

[73] Assignee: Wynn Oil Company, Fullerton, Calif.

[ * ] Notice: The portion of the term of this patent subsequent to Aug. 4, 2004 has been disclaimed.

[21] Appl. No.: 89,598

[22] Filed: Aug. 27, 1987

[51] Int. Cl.[4] ..... C10M 1/14; C10M 1/22; C10M 1/18

[52] U.S. Cl. ..... 44/66; 44/63; 44/71; 44/72; 44/77

[58] Field of Search ..... 44/63, 66, 71, 72, 77

[56] References Cited

U.S. PATENT DOCUMENTS

| | | | |
|---|---|---|---|
| 2,891,851 | 6/1959 | Bailey et al. | 44/77 |
| 3,951,614 | 4/1976 | Honnen et al. | 44/71 |
| 4,684,373 | 8/1987 | Vataru . | |

*Primary Examiner*—William R. Dixon, Jr.

*Assistant Examiner*—David M. Brunsman

*Attorney, Agent, or Firm*—William W. Haefliger

[57] ABSTRACT

An additive composition for use in fuel to be combusted in an internal combustion engine, the composition comprising, in admixture form:

(a) between about 0.05 and 25% relative weight parts of an organic peroxide, and (b) between about 0.1 and 25% relative weight parts of detergent selected from the component group that consists of:

(i) fatty amines (ii) ethoxylated and propoxylated derivatives of fatty amines (iii) fatty diamines (iv) fatty imidazolines (v) polymeric amines and derivatives thereof (vi) combination of one or more of said (i) through (v) components with carboxylic acid or acids having from three to forty carbon atoms.

13 Claims, No Drawings

ADDITIVE COMPOSITION, FOR GASOLINE

This invention relates to gasoline additives. More particularly, it relates to a novel fuel additive composition which can be added to the fuel tank of an ordinary gasoline or Diesel engine and is capable of increasing the efficiency of fuel combustion within the engine, thereby boosting engine power, improving fuel economy, and reducing objectionable tailpipe emissions.

BACKGROUND OF THE INVENTION

Dwindling petroleum reserves and deterioration in air quality caused by automotive emissions have resulted in massive efforts to improve the gasoline engine. The basic problem is that the internal combustion engine is inherently inefficient. Only a small fraction of the gasoline that it burns is actually converted into useful power. The remainder is dissipated in the form of heat or vibration, or consumed in overcoming friction between the engine's many moving parts. Some of the gasoline that enters the combustion chamber is not completely burned, and passes out the tailpipe as hydrocarbons (HC) or carbon monoxide (CO), two major components of air pollution or "smog". In view of the millions of automobiles and other gasoline-powered and Diesel powered vehicles and engines operating in the world, it is evident that even a miniscule improvement in engine efficiency could result in substantial savings of petroleum and significant reductions in air pollution.

Combustion is an extremely complex reaction, especially under the conditions that exist in the cylinders of an internal combustion engine. However it is obvious that the efficiency of combustion will depend, at least in part, on the amount of oxygen that is present to support it. Various attempts have been made over the years to increase the amount of oxygen available to the combustion chamber. Devices such as turbocharges, superchargers, and auxiliary air injectors have been frequently employed to increase the air supply to the engine. Pure oxygen gas itself has been added to the air stream—for example, by Meeks, U.S. Pat. No. 3,877,450 or Gerry, U.S. Pat. No. 3,961,609. Devices for adding nitrous oxide, an oxygen substitute, to fuel-air mixtures have also been used.

Whereas these approaches have been at least partially successful, they require the installation of supplemental apparatus to the engine—e.g. a turbocharger, an oxygen tank and associated metering equipment, etc. It is desirable to incorporate something directly into the fuel that is capable of liberating supplemental oxygen in the combustion chamber. Such a chemical would be particularly useful if it could be simply added as needed to the gasoline tank by the consumer in the form of an aftermarket fuel additive. Over the years, the derivatives of hydrogen peroxide have been studied as possible sources of supplemental oxygen for the fuel in the combustion chamber. For example, Hirschey, U.S. Pat. No. 4,045,188, discloses a gasoline additive comprising a mixture of di-tertiary butyl peroxide with tertiary butyl alcohol as a stabilizer. Improvements in fuel economy were observed at the recommended treat levels. Some problems were observed, however, if the peroxide was used in excess of the recommended concentrations, the fuel economy actually deteriorated and there was a decrease, not an increase, in mileage. This sensitivity to concentration would present a problem to a consumer, inasmuch as it is not always easy to measure a precise amount of additive into a precise amount of gasoline in an ordinary gas tank. Moreover the presence of the tertiary butyl alcohol could also be a drawback, inasmuch as excessive amounts of alcohol in gasolines may have adverse effects on certain fuel system components and may also promote corrosion, water absorption, and other problems.

Earle, U.S. Pat. No. 4,298,351, discloses a fuel composition comprising methanol and from 7 to 25% of a tertiary alkyl peroxide. This composition is intended for use as a gasoline substitute—however, it may also be employed in admixture with gasoline. Problems with autoignition and accompanying knocking in a conventional gasoline engine could be overcome by the addition of water and isopropanol. As with Hirschey, the use of alcohols, especially with added water, could present difficulties.

Harris and Peters in the journal *Combustion Science and Technology*, Vol.29, pp. 293–298 (1982), describe the results of a study on mixtures of from 1 to 5 ditertiary butyl peroxide in unleaded gasoline. A laboratory test engine was used, and improvements in the lead combustion of the fuel were observed. This reference, which teaches the utility of organic peroxide by itself, is considered to be close prior art.

SUMMARY OF THE INVENTION

In accordance with the present invention, the efficiency of combustion within an internal combustion engine can be improved by incorporating into the fuel a minor amount of a additive composition comprising the following components:

(a) an organic peroxide such as di-tertiary butyl peroxide within a specified range;

(b) a gasoline detergent within a specified range and selected from amines, diamines, polymeric amines, and combinations thereof with carboxylic acids; and (c) a suitable hydrocarbon solvent for the peroxide and detergent, and compatible with fuel such gasoline and Diesel fuel. The composition, which can be usefully employed by a consumer in the form of an aftermarket additive to be poured into the fuel tank, is capable of boosting engine horsepower, improving fuel economy, and reducing HC and CO tailpipe emissions. It does not require the addition of alcohols and has not exhibited the concentration dependency shown by the compositions of Hirschey. Moreover it has been found to exhibit improved properties compared to the use of organic peroxides by themselves.

DETAILED DESCRIPTION OF THE INVENTION

The components of the composition of the invention are chemicals that are well known to workers in the art. Organic peroxides are the derivatives of hydrogen peroxide, H—O—O—H, wherein both of the hydrogen atoms have been substituted by alkyl, aryl, carbalkoxy, carbaryloxy, etc. Many organic peroxides are unstable even at room temperature and thus would be unsuitable for a gasoline additive that might be subjected to prolonged periods of storage before actual use in the vehicle. Of those organic peroxides which are commercially available, di-tertiary butyl peroxide, t—$C_4H_9$—O—O—t—$C_4H_9$, has excellent stability and shelf life and is the organic peroxide of choice in the invention. However, as would be obvious to the skilled worker, any other organic peroxide of comparable stability could be substituted for the di-tertiary butyl peroxide if it were soluble in and compatible with gasoline and the other components of our invention. Hydroperoxides, R—O—O—H, which are derivatives of hydrogen peroxide wherein only one hydrogen has been replaced by an alkyl group, are also organic peroxides and could be used in the invention if they met the requirements for stability and compatibility.

Gasoline detergents are commonly employed in gasoline for the purposes of maintaining fuel system cleanliess, absorbing traces of moisture, and resisting rust and corrosion. It is desirable that such detergents be ashless—that is, contain no metal salts and burn cleanly in the combustion chamber. It is further desirable that they contain no elements such as phosphorus which could be detrimental to the performance of a catalytic converter or other emission control device. Gasoline detergents to be used according to the invention are the fatty amines and the ethoxylated and propoxylated derivatives thereof, as well as fatty diamines such as tallow propylenediamine. The reaction of a fatty acid having from about ten to about twenty carbon atoms and mixtures thereof with ethylene diamine or derivatives thereof such as N-hydroxyethyl ethylenediamine gives rise to cyclic amines called imidazolines. These fatty imidazolines are very useful as gasoline detergents. Polymeric amines and derivatives thereof such as the polybuteneamines and polybuteneamine polyethers have also proved efficacious as gasoline detergents and are claimed to offer some advantages over conventional amines, especially in the area of intake valve clealiness. The amines, diamines, fatty imidazolines, and polymeric amines are all useful as the gasoline detergent components of the invention. In combination with these amines, carboxylic acids may be used, as is well known in the art, such carboxylic acids having from three to forty carbon atoms. Among preferred carboxylic acids to be used in combination with the amine detergents are the 2,2-dimethylalkanoic acids having from about five to about thirteen carbon atms, oleic acid, and the dimerized acid of linoleic acid.

An appropriate hydrocarbon solvent for the other components must be compatible with gasoline and Diesel fuel and must not have an adverse effect on the performance of the fuel in the engine. Ordinary unleaded gasoline itself could be acceptable. However, because of its low flash point and the resulting flammability hazard, it is much preferred to employ a higher boiling solvent such as a well-refined kerosene or fuel oil. A suitable hydrocarbon solvent is a fuel oil with the following characteristics: specific gravity (15.5° C.) 0.8 (7 pounds/gallon); flash point (Penske-Marten) 65°-100° C., boiling poin range 230°-375° C., sulfur content 0.2% or less.

The relatve concentrations of the components are as follows:

| | Useful | Preferred #1 | Preferred #2 |
|---|---|---|---|
| The organic peroxide | 0.05 to 25 wt. % | 1.5 to 9.0 wt. % | about 15 wt. % |
| The gasoline detergent | 0.1 to 25 wt. % | 2.5 to 9.0 wt. % | about 23 wt. % |
| Hydrocarbon solvent | 50 to 99.0 wt. % | 60 to 98 wt. % | about 62 wt. % |

The above additive composition is intended for use in either unleaded or leaded gasoline or Diesel fuel at a treat level of from about 0.01 to 5%, and more preferably between about 0.1 to 2.0%. It may be added to the gasoline or Diesel fuel at the refinery or at any stage of subsequent storage. But its primary utility is seen as an aftermarket gasoline additive, sold over the counter in a relatively small package to a consumer who then adds it directly to his or her gas tank.

Examples or the invention and its use and testing will now be presented.

| | Example 1 | Example 2 | Example 3 | Example 4 |
|---|---|---|---|---|
| Di-tertiary butyl peroxide | 5.0% | 5.0% | 15% | 24% |
| Gasoline detergent (1) | none | 6.0% | 23% | 26% |
| Fuel oil bp. 230-375° C. | 95.0% | 89.0% | 62% | 50% |

Note (1): The gasoline detergent is a mixture of 4.0% fatty imidazoline and 2.0% dimethyl alkanoic acid The composition of Example 1 merely a diluted solution of di-tertiary butyl peroxide. Thus it is representative of the teachings of prior art such as Harris and Peters and is outside the scope of the invention. The compositions of Examples 2, 3 and 4 on the other hand, incorporates a gasoline detergent in admixture with th organic peroxide and is within the scope of the invention.

The compositions of Examples 1 and 2 were compared in a test vehicle by an independent automotive testing laboratory by means of the "transient 505" dynamometer test. This procedure is a portion of the Federal Test Procedure described in 40 CFR Part 600, Appendix 1, and simulates a 3.5 mile urban driving cycle. The test vehicle is a run on a dynamometer according to the prescribed protocol, the exhaust emissions are captured and analyzed, and the gasoline mileage is computed from the emissions, using the following equation:

$$\text{Miles/gallon} = \frac{2430}{(0.866 \times HC) + (0.429 \times CO) + (0.273 \times CO_2)}$$

wherein HC, CO, and $Co_2$ are the emissions of hydrocarbon, carbon monoxide and carbon dioxide in grams/mile respectively, and the 2430 is a constant for the fuel used in the test. This fuel is an unleaded test gasoline formulated to EPA specifications and is known as "Indolene".

Inasmuch as older vehicles may have developed fuel system and combustion chamber deposits that could compromise the accuracy of the emissions data during the test, a new vehicle was chosen as the test car—a 1986 Toyota Corolla with a 1.6 liter 4-cylinder carbureted engine. The odometer reading was 786 miles. Three sets of duplicate transient 505 runs were carried out—the first pair with Indolene alone as the fuel, the second pair with Indolene containing 1.2% of the composition of Example 1, the third pair with Indolene containing 1.2% of the composition of Example 2. The average emissions and mileage computations for each pair of runs are given below.

| TRANSIENT 505 TESTS | | | |
|---|---|---|---|
| Fuel | Average HC (gm/mk) | CO (gm/mi) | Mileage (mi/gal) |
| Indolene | 0.048 | 0.190 | 31.460 |
| Indolene + 1.2% Ex. 1 | 0.029 | 0.332 | 31.423 |
| Indolene + 1.2% Ex. 2 | 0.027 | 0.124 | 31.931 |

Note the surprising finding that, whereas both Example 1 (outside the scope of the invention) and Example 2 (within the scope of the invention) lowered hydrocarbon (HC) emissions to a similar extent, only the composition of the invention also lowered carbon monoxide (CO) emissions. Moreover, only the composition of the invention showed an improvement in fuel economy (from 31.460 to 3.931 miles/gallon, 1.5% improvement). The use of the di-tertiary butyl peroxide alone actually gave an increase in CO emissions (from 0.190 to 0.332 gm/mi) and showed no improvement in mileage, compared with the runs where neither additive was used. Thus these tests show a superiority of the composition of Example 2 over a composition containing the organic peroxide by itself, and thus clearly distinguish the invention from the teachings of the prior art showing organic peroxides in gasoline.

FURTHER TESTING

California requires periodic inspection of automobiles to insure their emissions control equipment is still functioning. This testing is carried out by independent state-licensed test centers. The following vehicles were taken to a test center for determination of emissions levels: a 1977 Buick 403 CID V-8 (carbureted), mileage 102,600, a 1984 Ford Mustang, 2.3L 4-cyl. (carbureted), mileage 57,000; a 1985 Chevrolet Cavalier, 2.0L 4-cyl. (fuel-injected), mileage 23,000. After testing, 0.6% of the composition of Example 2 was added to the fuel tanks, and the vehicles were brought back to the test center for re-test. In every case, hydrocarbon and carbon monoxide emissions were found to be lowered by addition of the invention.

Whereas fuel economy and emissions are important, the ordinary motorist is apt to measure the performance or lack thereof of an additive by its effect of the power of the engine. Dynamometer horsepower determinations were used to determine the effect of the use of the invention on engine power. An older vehicle, a 1976 Buick LeSabre with a 403 CID V-8 engine and a mileage of 124.000, was selected for these tests. Again, an independent test laboratory carried out the determinations. The following table lists horsepower results before and after additive of 0.5% of the composition of Example 2.

| HORSEPOWER TESTING | | |
|---|---|---|
| | Horsepower Readings | |
| Engine RPM | Before Additive Addition | After Addition |
| 2500 | 94 | 105 |
| 3000 | 110 | 114 |
| 3500 | 84 | 98 |
| 4000 | 50 | 96 |

At every RPM level tested, the addition of the invention resulted in an increase in horsepower, the results being particularly dramatic at the higher levels.

The fuel additive composition of this invention is capable of improving the efficiency of gasoline and Diesel fuel combustion, as shown by its ability to boose engine power, improve fuel economy, and reduce emissions. The invention was further shown to be superior to a composition containing organic peroxide alone, as shown in the prior art. The above Examples are submitted by way of illustration and are not meant to be limited within the scope of the following Claims.

The additive of the present invention is useful in Diesel fuel, as well as in gasoline, and is useful in gasoline containing alcohol and/or methanol, all being used as fuel for internal combustion engines. Higher peroxide levels are especially suited for heavier fuels such as Diesel fuel. The resultant fuel consists of the composition as referred to in admixture with gasoline or Diesel fuel, and wherein the composition is between 0.05 and 2.0 percent by weight of the fuel.

I claim:

1. An admixture that comprises Diesel fuel and an additive composition which is between 0.5 to about 2.0 percent by weight of the fuel, said additive composition comprising the following components:

(a) from about 0.05 to about 25% by weight of an organic peroxide;

(b) from about 0.1 to about 25% by weight of a detergent selected from fatty amines and the ethoxylated and propoxylated derivative thereof, a fatty diamines, fatty imidazolines formed by reaction of a fatty acid having from ten to twenty carbon atoms with ethylene diamine and derivatives thereof, polymeric amines and derivataives thereof, and combinations of said amines, diamines, fatty imidazolines, and polymeric amines with carboxylic acids having from three to forth carbon atoms;

(c) from about 99.0 to about 50% by weight of a hydrocarabon solvent selected from unleaded gasoline and higher boiling solvents compatible with gasoline and having no adverse effect on the performance of Diesel fuel in the engine.

2. The admixture composition of claim 1 wherein the organic peroxide component is di-tertiary butyl peroxide.

3. The admixture composition of claim 2 wherein the detergent is a fatty imidazoline in combination with a dimethyl alkanoic acid.

4. The admixture composition of claim 3 wherein the di-tertiary butyl peroxide is present at a level of about 0.05 to 12% and the fatty imidazoline and dimethyl alkanoic acid gasoline detergent combination is present at a level of from about 2 to 10%.

5. An admixture that comprises Diesel fuel and an additive composition added thereto which is between about 0.05 to about 2.0 percent by weight of the fuel, said composition comprising:

(a) between about 0.05 and 25% relative weight parts of an organic peroxide, and (b) between about 0.1 and 25% relative weight parts of detergent selected from the component group that consists of:

(i) fatty amines (ii) ethoxylated and propoxylated derivatives of fatty amines (iii) fatty diamines (iv) fatty imidazlines (v) polymeric amines and derivatives thereof, (vi) combination of one or more of said (i) through (v) components with carboxylic acid or acids having from three to forth carbon atoms, (c) from about 99.0 to about 50% by weight of a hydrocarabon solvent.

6. The admixture composition of claim 5 wherein said fatty imidazolines are formed by reaction of fatty acid having from ten to twenty carbon atoms with ethylene *diamine or derivatives thereof.*

7. The admixture composition of claim 5 wherein said hydrocarbon solvent is selected from the group consisting of (i) gasoline
(ii) kerosene
(iii) fuel oil.

8. The admixture composition of claim 5 wherein said carboxylic acid is selected from the group that consists of ($x_1$) 2,2-dimethylalkanoic acids having from about five to thirteen carbon atoms
($x_2$) oleic acid
($x_3$) dimerized acid of linoleic acid.

9. The admixture composition of claim 5 wherein said polymeric amine and derivatives thereof are selected from the group that consists of ($x_1$) polybuteneamine
($x_2$) polybuteneamine polyether.

10. The admixture composition of claim 5 wherein the organic peroxide is di-tertiary butyl peroxide.

11. The admixture composition of claim 10 wherein the detergent is fatty imidazoline in combination with a dimethyl alkanoic acid.

12. The admixture composition of claim 11 wherein the di-tertary butyl peroxide is present at a level of about 1 to 10% and the fatty imidazoline and dimethyl alkanoic acid gasoline detergent combination is present at a level of from about 1 to 12%.

13. The admixture composition of claim 5 that contains one of the following:

(i) methanol
(ii) alcohol.

* * * * *

UNITED STATES PATENT AND TRADEMARK OFFICE

CERTIFICATE OF CORRECTION

PATENT NO. : 4,797,134

DATED : January 10, 1989

INVENTOR(S) : Marcel Vataru

It is certified that error appears in the above-identified patent and that said Letters Patent is hereby corrected as shown below:

Column 6, line 26; "and propoxylated derivative thereof, a fatty di-" should read --and propoxylated derivatives thereof, fatty di- --

Signed and Sealed this

Twentieth Day of June, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,797,134

DATED : January 10, 1989

INVENTOR(S) : Marcel Vataru

It is certified that error appears in the above-identified patent and that said Letters Patent is hereby corrected as shown below:

Column 6, line 63; "(iv) fatty imidazlines" should read --(iv) fatty imidazolines--

Signed and Sealed this

Nineteenth Day of December, 1989

*Attest:*

JEFFREY M. SAMUELS

*Attesting Officer*

*Acting Commissioner of Patents and Trademarks*